United States Patent [19]

Chang

[11] Patent Number: 4,627,451

[45] **Date of Patent: * Dec. 9, 1986**

[54] MEANS OF COMB BRISTLES BY OVERALL PLANTING METHOD

[76] Inventor: Che-Yuan Chang, P.O. Box 10160, Taipei, Taiwan

[ * ] Notice: The portion of the term of this patent subsequent to Apr. 9, 2003 has been disclaimed.

[21] Appl. No.: 674,743

[22] Filed: Nov. 26, 1984

[51] Int. Cl.[4] ..... A45D 24/00

[52] U.S. Cl. ..... 132/11 A

[58] Field of Search ..... 132/11 A, 9, 127, 7, 132/108-109, 85, 151; 15/159 A, 180

[56] References Cited

U.S. PATENT DOCUMENTS

| | | | |
|---|---|---|---|
| 979,058 | 12/1910 | Bove | 132/127 |
| 1,556,958 | 10/1925 | Robison | 132/127 |
| 2,808,062 | 10/1957 | Schiffman | 132/151 |
| 3,254,424 | 6/1966 | Goble | 132/7 |
| 3,771,189 | 11/1973 | Horton et al. | 15/180 |
| 3,815,923 | 6/1974 | Goduto | 15/159 A |

*Primary Examiner*—Gregory E. McNeill

[57] ABSTRACT

An improved means of comb bristles includes a bristle holder integratedly formed with a plurality of bristles extending from a bristle base and an embedding element formed with a plurality of bristle holes on an embedding plate wherein the embedding plate is bound with the bristle plate by high-frequency heating, burning or mechanical engagement so that the bristles will not be retracted during combing operation.

4 Claims, 7 Drawing Figures

MEANS OF COMB BRISTLES BY OVERALL PLANTING METHOD

BACKGROUND OF INVENTION

Conventional comb is made by planting either manually or mechanically the individual metallic or plastic bristle into a rubber or plastic base which however has the following defects:

1. The production is slow and cost is higher.
2. If the bristles are made of plastic material, they will cause static electricity during combing operation which will influence the health of human hairs or body.
3. If the bristles are made of metallic material, they easily get rusty and will contaminate the comb user.
4. The conventional ironic bristles must be backed by adhering a rubber or plastic plate under the bristle base to prevent from retracting the bristles during combing operation. To adhere such a plastic or rubber plate on the back of bristle base will waste time, labor and will increase the production cost to lose its marketing competitive potential and economic value.

The present inventor has found the defects of conventional comb and invented the present improved means of bristles by overall planting method.

SUMMARY OF THE INVENTION

The object of the present invention is to provide an improved means of comb bristles by integratedly combining a bristle holder preformed with plurality of bristles with an embedding element so that the combination means can be easily and fastly fixed on a comb back.

DETAILED DESCRIPTION

Figure 2:
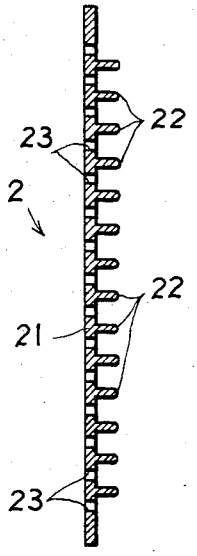
FIG. 2 is a sectional drawing of the embedding element in accordance with the present invention.
Figure 1:
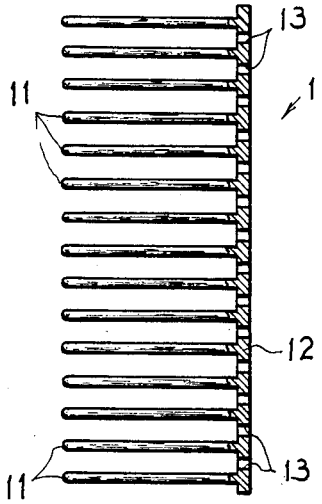
FIG. 1 is a sectional drawing of the bristle holder in accordance with the present invention.
Figure 3:
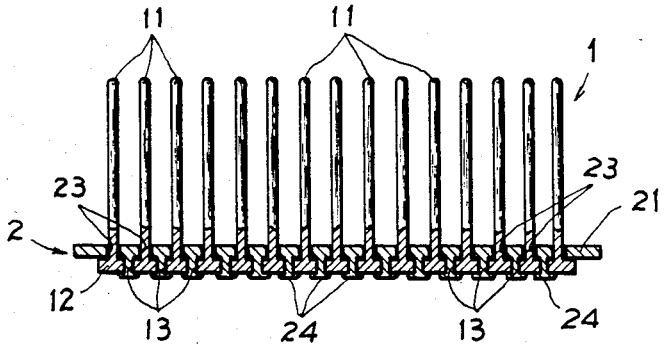
FIG. 3 is a sectional drawing by combining the bristle holder with the embedding element in accordance with the present invention.

As shown in FIGS. 1, 2 and 3, the present invention comprises a bristle holder 1 and an embedding element 2. Bristle holder 1 is made of plastic, rubber or other suitable materials by integrated injection molding process so that the formed bristle holder includes a bristle base 12 and a plurality of bristles 11 directly extending from the base 12. The bristle base 12 can be made as a complete form to contain all rows of bristles 11 or just made as a single row configuration including single-row bristle base with single-row bristles extending from the bristle base. The bristles 11 are then overall electroplated to form beautiful appearance and to prevent from static electricity during combing operation. Bristle base 12 is formed with a plurality of holes 13 each positioned between every two bristles 11.

Embedding element 2 comprises an embedding plate 21 made of plastic or rubber material, a plurality of fixing tips 22 extending from plate 21 and each tip 22 corresponding to each hole 13 formed on bristle base 12, and a plurality of bristle holes 23 formed on plate 21 and each corresponding to each bristle 11.

By fixing embedding element 2 with bristle holder 1, all the fixing tips 22 are inserted into holes 13 and then melted by burning or heating all tip ends to form butts 24 as FIG. 3 shown to seal all holes 13 and to firmly bind embedding plate 21 with bristle base 12 to prevent from the retraction of bristles 11 during combing.

Figure 4:
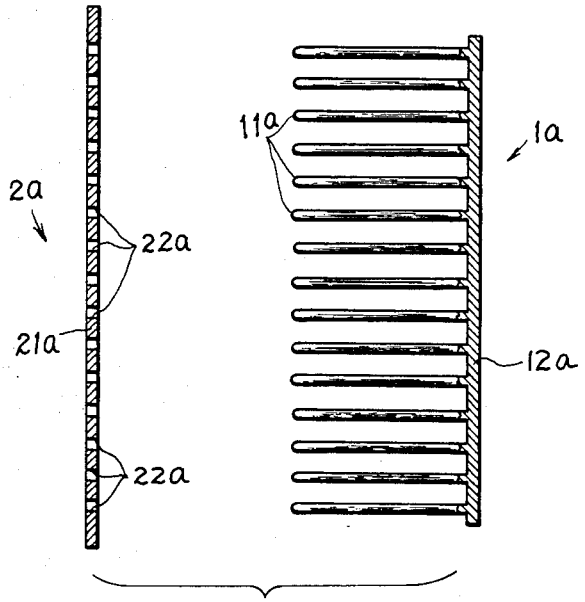
FIG. 4 shows the sectional drawing of a bristle holder and an embedding element of another preferred embodiment of the present invention.
Figure 5:
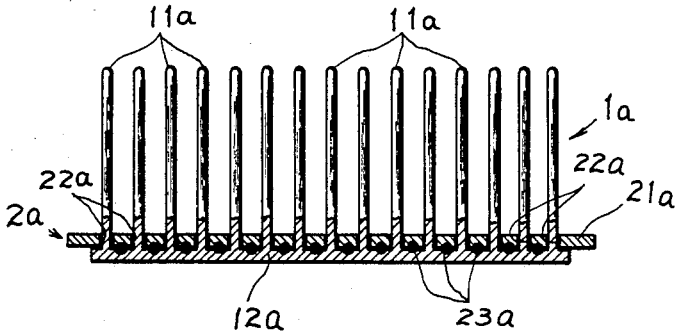
FIG. 5 shows the sectional drawing of the combination means of bristle holder and embedding element of FIG. 4.

Another preferred embodiment of the present invention is shown in FIGS. 4 and 5, which comprises a bristle holder 1*a* and an embedding element 2*a*. Bristle holder 1*a* is integratedly formed with a plurality of bristles 11*a* extending from a bristle base 12*a*. Embedding element 2*a* is formed as an embedding plate 21*a* which is formed with a plurality of holes 22*a* each corresponding to each bristle 11*a*. After combining embedding element 2*a* with bristle holder 1*a*, high-frequency heating is applied to bind embedding plate 21*a* on bristle base 12*a* to form a plurality of fusion points 23*a* as FIG. 5 shown so as to prevent from retraction of bristles 11*a* during combing.

Figure 6:
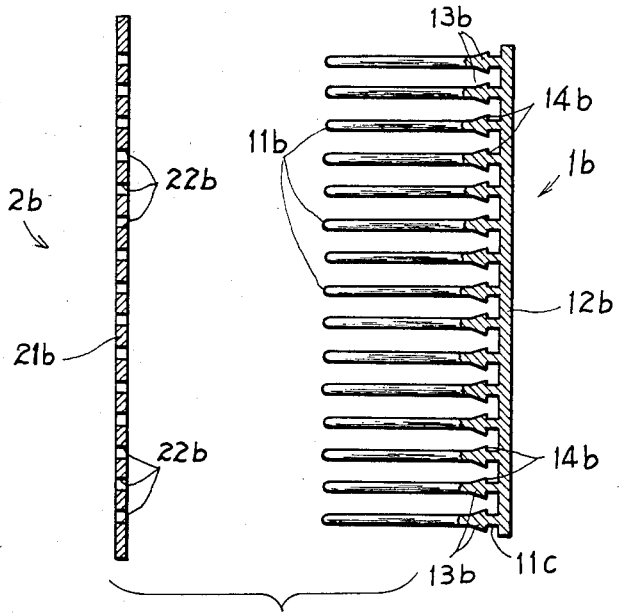
FIG. 6 shows the sectional drawing of a bristle holder and an embedding element of still another preferred embodiment of the present invention.
Figure 7:
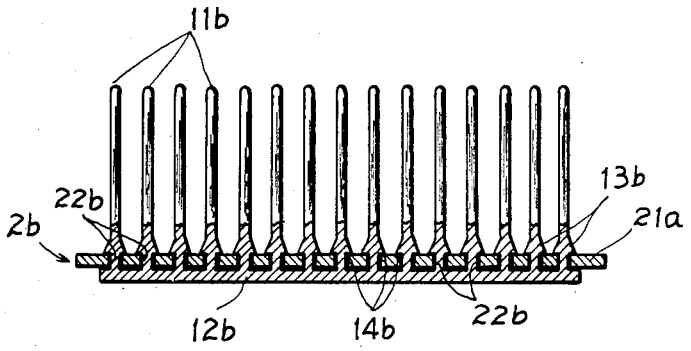
FIG. 7 is a sectional drawing of the combination means of bristle holder and embedding element of FIG. 6.

Still another preferred embodiment of the present invention is shown in FIGS. 6 and 7, which comprises a bristle holder 1*b* and an embedding element 2*b*. Bristle holder 1*b* is formed with a plurality of bristle 11*b* extending from bristle base 12*b*. On the lower portion of each bristle 11*b*, there is provided with a truncated cone portion 13*b* expanding downwards from the bristle perimeter to form a lower ratchet edge 14*b* whose diameter is slightly larger than that of the bristle 11*b*. The length of neck portion 11*c* between lower ratchet edge 14*b* and base 12*b* is equal to the thickness of embedding plate 21*b*. Embedding element 2*b* is formed with a plurality of bristle holes 22*b* on the embedding plate 21*b*. The bristles 11*b* of bristle holder 1*b* are inserted into holes 22*b* of embedding element 2*b*. After passing the holes 22*b*, the lower ratchet edges 14*b* will serve as a stop to prevent from retraction of bristles 11*b* of the present invention.

The present invention has the following advantages in comparison with the conventional combs:

1. The bristles are overall formed on a comb either by combining a complete bristle holder of full bristles with an embedding plate or by combining all single-row bristle holders with an embedding plate which will greatly reduce the production time and cost than the conventional comb by planting each individual bristle on the bristle base.
2. The tough plastic bristles of the present invention are overall electroplated to have the equivalent effect of conventional metallic bristles, but to have much resilience and anti-rust properties than conventional ironic bristles.
3. The present invention can prevent from retraction of the bristles than conventional bristles, which must be further retarded by adhering a cloth or rubber plate on the back of bristle base, so that it may enhance the comb quality and reduce the production cost.

I claim:

1. An improved means of comb bristles comprising:

a bristle holder which is integratedly formed with a plurality of bristles extending from a bristle base and a plurality of holes on said bristle base, each hole positioned between every two bristles; and an embedding element which is formed with a plurality of fixing tips each corresponding to each hole on said bristle base, and a plurality of bristle holes corresponding to said bristles, said embedding element being combined with said bristle holder by inserting all fixing tips into all holes on said bristle base and then heating said fixing tips to melt as butts to seal all holes on said bristle base and firmly bind said embedding plate with said bristle base to prevent from the retraction of said bristles during combing operation, said bristles being overall electroplated before inserting into embedding plate to have beautiful appearance and prevent from rust.

2. An improved means of comb bristles according to claim 1, wherein said bristle base is made as a single-row configuration by forming single-row bristles thereon, said single-row bristles being overall electroplated and said single-row bristle bases being combined with said embedding plate subsequently to form a complete combination means.

3. An improved means of comb bristles comprising:

a bristle holder integratedly formed with a plurality of bristles on a bristle base; and an embedding element formed with a plurality of bristle holes corresponding to said bristles on an embedding plate, said embedding plate being combined with said bristle base and being bound by applying high-frequency heating to form a plurality of fusion points therebetween to prevent from the retraction of said bristles during combing operation.

4. An improved means of comb bristle comprising:

a bristle holder formed with a plurality of bristles on a bristle base, in which each said bristle is formed with a truncated cone portion on the lower portion of said bristle, said truncated cone portion being expanded downwards from said bristle to form a lower ratchet edge whose diameter is slightly larger than that of said bristle; and an embedding element formed with a plurality of bristle holes on an embedding plate, said bristle holder being combined with said embedding element after inserting all said truncated cone portions through said bristle holes whereby each said bristle can not be retracted from said embedding plate as obstructed by said lower ratchet edge on said bristle, said length of neck portion between said lower ratchet edge and bristle base being equal to said thickness of said embedding plate.

* * * * *